United States Patent [19]

Wittes

[11] Patent Number: 4,486,065

[45] Date of Patent: Dec. 4, 1984

[54] STRAIN-RELIEF ELECTRICAL CABLE CONNECTOR

[76] Inventor: James M. Wittes, 40 Palisade Rd., Linden, N.J. 07076

[21] Appl. No.: 510,919

[22] Filed: Jul. 5, 1983

Related U.S. Application Data

[63] Continuation-in-part of Ser. No. 257,979, Apr. 27, 1981, abandoned.

[51] Int. Cl.[3] ..... H01R 13/58

[52] U.S. Cl. ..... 339/103 B

[58] Field of Search ..... 339/103 B, 105; 174/153 G; 248/56

[56] References Cited

U.S. PATENT DOCUMENTS

| | | | |
|---|---|---|---|
| 3,249,687 | 5/1966 | Klumpp | 174/153 G |
| 3,424,856 | 1/1969 | Coldren | 174/153 G |
| 3,953,665 | 4/1976 | Nicholson | 248/56 X |
| 4,000,875 | 1/1977 | Jemison et al. | 339/103 B X |
| 4,002,821 | 1/1977 | Satoh et al. | 248/56 X |
| 4,033,535 | 7/1977 | Moran | 339/103 B X |
| 4,034,944 | 7/1977 | Moran | 339/103 B X |
| 4,190,222 | 2/1980 | Appleton et al. | 248/56 |

*Primary Examiner*—Eugene F. Desmond

*Attorney, Agent, or Firm*—Gregor N. Neff

[57] ABSTRACT

The connector or bushing fits into a "knock-out" hole in the wall of a junction box or the like in order to protect the cable or wires from contact with the box and to provide "strain relief", that is, to hold the cable or wire securely to prevent its conductors from being pulled loose from the electrical terminals to which they are connected. The connector has a first body member or "yoke" and a second body member or "wedge", both of which are formed in a single molding operation and are attached to one another temporarily. The yoke is fitted into the knock-out hole but only partially fills the hole. The cable is inserted through a hole in the yoke. The wedge slides in slots in the yoke and is shaped and positioned so that pressure applied to it by means of a screwdriver will cause it to break loose from the yoke, slide in the slots, and become wedged between the cable and one edge of the hole. This structure serves the dual function of holding the connector solidly in place in the wall of the box, while also providing strain relief for the cable. The connector is relatively small and inexpensive to make, and it is relatively easy to use. It can be removed and re-used, if desired. The assembly of the parts of the connector, the clamping of the cable, and the seating of the connector in the hole all are completed with a single stroke of a screwdriver, without moving the cable longitudinally.

29 Claims, 12 Drawing Figures

FIG. 1
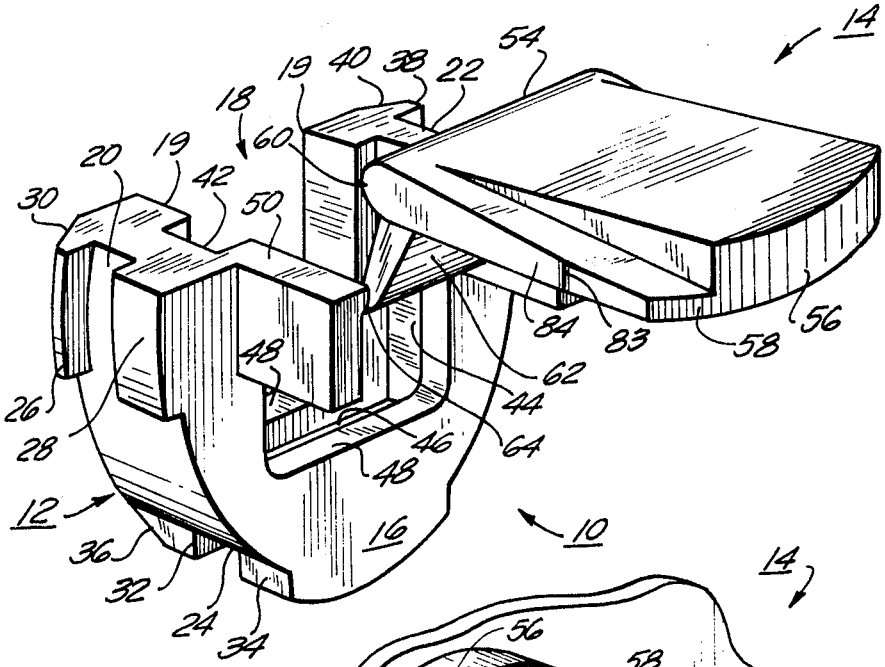
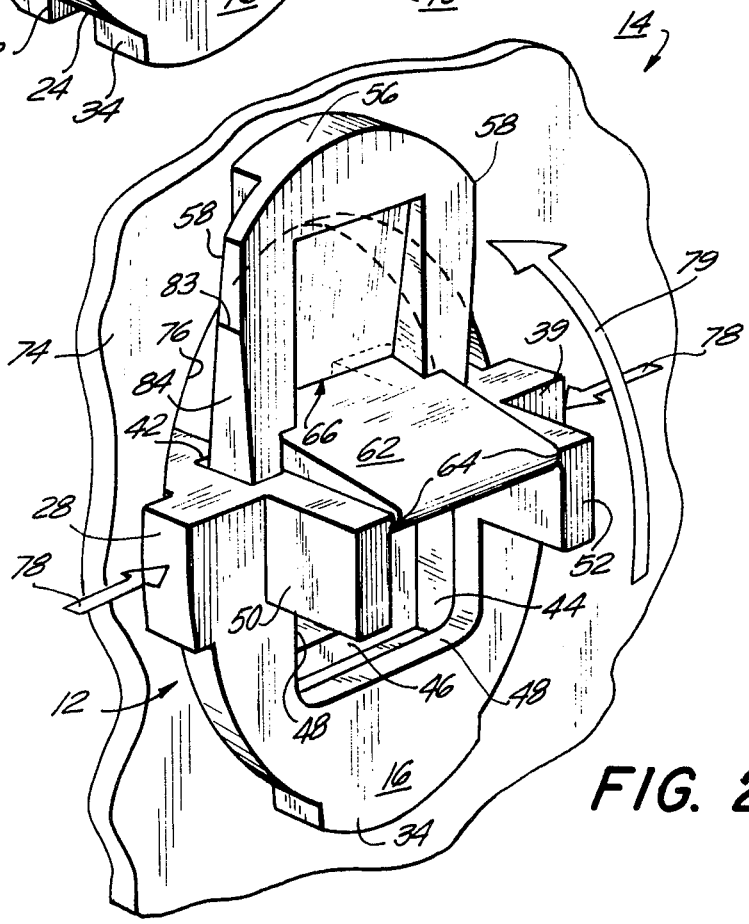
FIG. 2

STRAIN-RELIEF ELECTRICAL CABLE CONNECTOR

This patent application is a continuation-in-part of U.S. patent application Ser. No. 257,979 filed Apr. 27, 1981, now abandoned.

This invention relates to insulating connectors or bushings for electrical wiring and methods of using them, and particularly relates to connectors or bushings which provide strain relief and methods of using them.

A number of different types of molded plastic strain-relief cable connectors or bushings have been proposed in the past. None of those connectors is entirely satisfactory.

Many of such prior connectors are relatively large. This is a serious disadvantage when the connectors are to be used in cramped quarters, such as in electrical switch or receptacle boxes, circuit breaker panels with a multitude of cable terminations, and the like. Moreover, such connectors require substantial amounts of material and are undesirably costly to make.

Accordingly, it is one object of the present invention to provide a strain-relief cable connector which is relatively compact and uses relatively small amounts of material.

Certain types of prior connectors require cams, screws, or other parts which are separate from the main body of the connector. These parts must be manufactured separately and then assembled. The extra manufacturing and assembly steps add significantly to the cost of the connector.

Accordingly, it is another object of the present invention to provide a strain-relief connector which requires little or no assembly.

It is yet another object to provide such a connector which can be molded with the use of a relatively small mold so as to further reduce manufacturing costs.

In a number of prior molded plastic connector devices, the plastic parts of the connector are stressed in a tension mode, or in a bending or shear mode. This requires the use of relatively exotic materials or reinforced plastic materials which add further to the cost of the connector.

Therefore, it is a further object of the invention to provide a molded plastic strain-relief cable connector which subjects the parts to relatively low tension, bending or shear forces, and yet holds the cable securely and reliably.

Certain prior strain-relief connectors are relatively difficult to fit into the "knock-out" hole in the wall of the receptacle or junction box. Additionally, the opening through which the cable or conductor must be passed is relatively small. These disadvantages make the connector more difficult to use.

It is yet another object of the invention, therefore, to provide a molded plastic strain-relief cable connector which is relatively easy to fit into the mounting hole and which has a relatively large opening through which to pass the cable.

Some prior connectors can be inserted into the mounting hole only from the outside of the box, usually because they would take up too much space if they were mounted inside the box. Still other prior connectors require the use of special tools in order to mount them and/or clamp the cable in them.

Accordingly. it is another object of the invention to provide a strain-relief cable connector which can be inserted either from inside or outside of a connection box, and which requires no special tools for its use.

Certain other prior connectors have two parts which are connected by a molded flexible strap. The parts must be assembled onto the cable with both parts outside of the knock-out hole. Then, while holding the parts together, the assembly is forced into the hole. Such connectors are difficult to use. Moreover, when the parts are inserted into the knock-out hole, the cable must move with them. The resulting movement of the cable often is undesirable.

It is, therefore, yet another object of the invention to provide a connector whose parts need not be assembled on the cable outside of the mounting hole, and which does not cause the cable to move when it is being mounted in the hole.

The foregoing objects are met, in accordance with the present invention, by the provision of a strain-relief connector which has a first body member which is shaped to fit into the edge of a hole in a wall and a second body member shaped to be wedged between the conductor and the edge of the mounting hole. This arrangement has the advantage that it both clamps the cable in the connector, and also securely fastens the connector to the wall of the box. Therefore, a single structure serves a dual purpose Preferably, the second body member slides in grooves or slots in the first body member, and has a recess into which a screwdriver can be inserted to wedge the second member between the insulated conductor and the edge of the hole.

In the preferred method of use, the first body member is mounted in the mounting hole by hand. The cable is inserted into a passageway in the first body member either before or after that member is inserted into the mounting hole. Then the second body member is fitted into place. Thus, with one stroke of a screwdriver, the two parts are assembled, the cable is clamped, and the connector is mounted securely to the wall of the junction box. Notably, this is accomplished without moving the cable.

The connector is relatively compact and simple to mold, and uses a relatively small amount of material.

Preferably, the connector is molded in one molding operation with the two parts being temporarily joined by a hinge which is designed to break during the installation of of the connector, after it has served its purpose. Thus, the molding process is a one-step process, and no assembly is required.

The connector is relatively easy to mount into the panel hole, and has a relatively large opening through which the cable passes. Therefore, it is relatively easy to install.

The connector can be inserted either from the inside or the outside of a junction box, and it requires no special tools for installation. An ordinary screwdriver is quite sufficient for this purpose.

Because the principal stresses on the parts of the connector are compression stresses rather than tension, shear or bending stresses, relatively low-strength and inexpensive materials can be used to make the connector.

Other objects and advantages of the invention will be set forth in or apparent from the following description and drawings. In the drawings:

FIG. 1 is a perspective view of the preferred embodiment of the strain-relief connector of the present invention;

FIG. 2 is a perspective view of the connector of FIG. 1 with the connector inserted in a hole in a wall and with a cable inserted, ready to be clamped;

Referring first to FIG. 1, the connector 10 includes a first body member or "yoke" 12 and a second body member or "wedge" 14. As it will be explained in greater detail below, the two body members 12 and 14 are fastened together by frangible hinges at points 64 (see FIG. 2 as well as FIG. 1).

Figure 4:
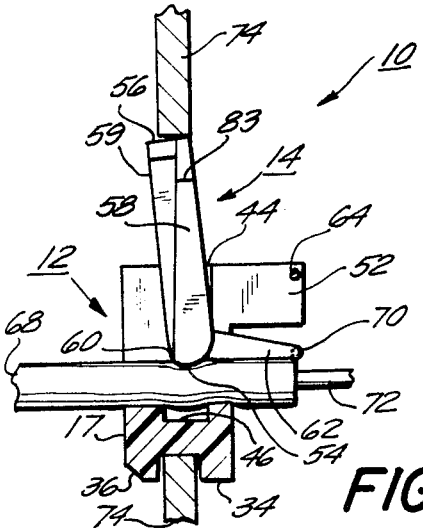
FIG. 4 is a cross-sectional view taken along line 4—4 of FIG. 3.

The yoke 12 is a semi-cylindrical in external shape, with a front-surface 16 and a rear surface 17 (see FIG. 4). The yoke 12 is slightly larger than half of a cylinder. It has a large central recess 18 which extends axially through the yoke. This recess is generally rectangular in shape and has side walls 19 and a pair of bottom walls 48. A recess 46 separates the bottom walls 48 from one another axially. This structure gives the body 12 the shape of a yoke.

Three grooves 20, 22 and 24 are formed in the outside surface of the yoke 12. The groove 20 is located on one side and near the top of the yoke 12 and is formed by projections 26 and 28. Projection 26 has an inclined rear face 30 in order to provide a "camming" action to help push the left side of the yoke 12 inwardly when the yoke is being pushed into a hole in the wall of the receptacle.

The groove 24 is located at the bottom of the yoke 12, and is formed by projections 32 and 34. An inclined rear face 36 (also see FIG. 4) is provided for the projection 32, also for the purposes of camming and assisting in seating the yoke in the mounting hole.

The groove 22 is formed by projections 38 and 39 (also see FIG. 3), with projection 38 having an inclined rear surface 40 serving the same purpose as the surfaces 30 and 36.

Each groove 20, 22 and 24 has a width sufficient to receive the edge of the wall of a junction box, receptacle box, cricuit-breaker panel or the like into which the connector is designed to be fitted.

The second body member or wedge 14 is generally planar and rectangular in shape. It has a straight lower edge 54, a curved upper edge 56, and two tapered ribs 58 extending outwardly at each side. As it is shown in FIG. 4, each rib 58 is relatively wide at its lower end 60 and narrow at its upper end.

Figure 5:
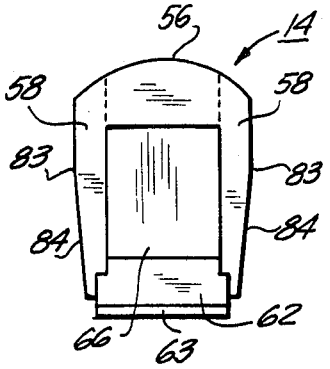
FIG. 5 is a front elevation view of a component of the connector of FIGS. 1–4.

FIG. 5, which is a front elevation view of the wedge member 14, shows that the ribs 58 are tapered in another dimension. Each rib has a ramp portion 84 which slopes slightly outwardly up to a point 83. The sides of the ribs 58 are parallel to the vertical axis of the wedge member from the point 83 up to the start of the curved upper edge 56.

A projection 62 extends transversely out from the plane of the body of the wedge member 14 near the bottom edge 54. This projection 62 is connected at two points 64 to a pair of projections or arms 50 and 52 which extend from the front face 16 of the yoke 12. Preferably, the connections at the points 64 are formed in the molding process; the two parts 12 and 14 are molded simultaneously in the same mold, with the only connections between them being at points 64.

FIG. 2 shows the connector 10 after it has been inserted into a hole 76 in the wall 74 of a junction box, receptacle, or the like. The edge of the hole is fitted into the grooves 20, 22 and 24. The way in which this is accomplished is as follows.

Because of the central recess 18 (see FIG. 1) in the yoke 12, and because the plastic material of which the connector 10 is molded is relatively flexible and resilient, the sides of the yoke 12 are relatively flexible. Thus, they can be pressed inwardly with finger pressure applied to the sides in the directions of the arrows 78 (FIG. 2).

The lower rear projection 32 at the bottom of the yoke 12 is hooked over the rear edge of the hole so as to seat the wall forming the bottom edge of the hole in the groove 24. Then the sides of the yoke are squeezed inwardly. When this is done, yoke 12 deforms and pivots about the body member 14 on the hinges 64, and the projections 26 and 38 at the rear of the connector move inwardly more than the other projections, thus depressing them far enough to fit into the hole. Then the top portion of the yoke is pressed into the hole. If the sides of the yoke have not been pressed inwardly far enough, pressing the inclined edges 30 and 40 against the edge of the hole will force the projections 26 and 38 farther inwardly and past the edge 76 of the hole. When the sides of the yoke are released, the resiliency of the arms of the yoke causes the wall to be seated in the grooves 20 and 22.

By providing three angularly-spaced pairs of projections to form the grooves 20, 22 and 24, the insertion of the connector is made easier and faster than it would be if one continuous groove were formed by two continuous flanges.

As it is shown in FIG. 1, the yoke 12 has two vertical grooves 42 and 44 in the side-walls 19 of the recess 18. These grooves have a width only slightly wider than the base 60 of the wedge 14.

The distances from the hinges 64 to the grooves 42 and 44 are approximately equal to the distances from the hinges 64 to the rear surface of the wedge 14. Thus, when the end 56 of the wedge 14 is lifted upwardly by hand, it swings on the pivots 64 and rotates in an arc 79 (FIG. 2) to a position in which it fits into the grooves 42 and 44. FIG. 2 shows the wedge 14 after it has been positioned in this manner.

As it can be seen from FIG. 2, the foregoing procedure leaves a relatively large passageway below the projection 62 and above the edges 48 through which a cable or other conductors can be inserted. This makes it relatively easy to insert the cable.

If the cable has been inserted through the knock-out hole prior to the connector 10, the wedge 14 can be disconnected from the yoke 12, the yoke snapped into the knock-out hole around the cable, and the wedge introduced into the grooves 42 and 44 and driven home.

Figure 3:
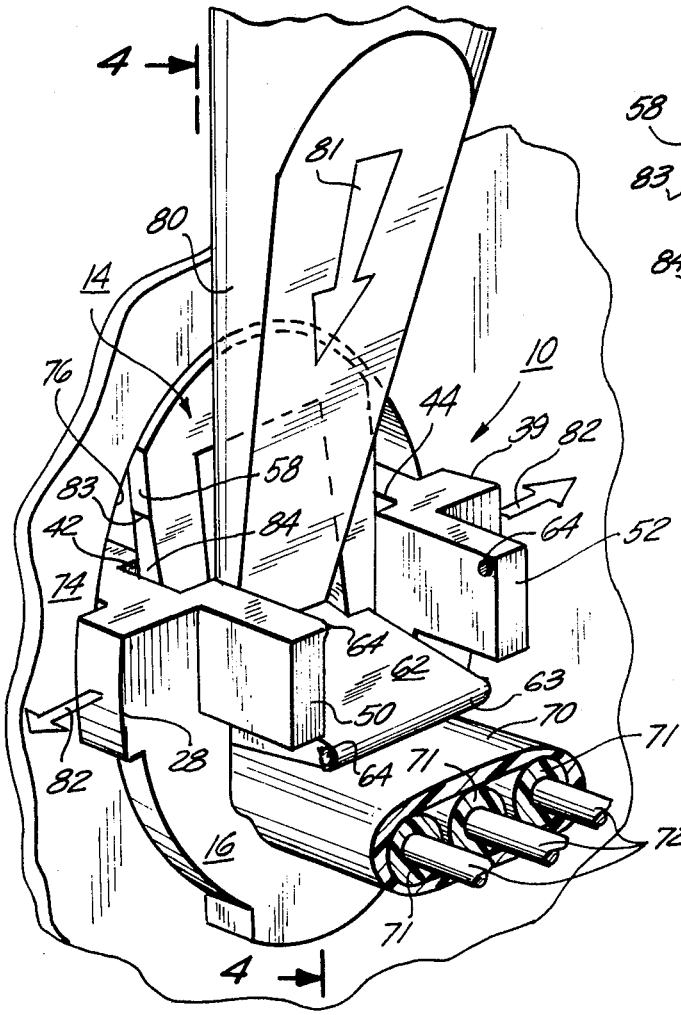
FIG. 3 is a perspective view showing the device of FIG. 2 with the cable being clamped, with the aid of a screwdriver.

FIG. 3 shows the connector 10 after a cable 68 (see FIG. 4) has been inserted through it. The cable 68 has plastic insulation 70 on the outside, and conductors 72 inside, each of which has its own insulation 71. The cable 68 is flat. However, the connector 10 also can be used with round cable or cable having other shapes.

As it is shown in FIG. 2, the wedge 14 has a cavity 66 shaped to receive the tip of a screwdriver or similar tool. FIG. 3 also shows the wedge 14 after it has been pushed downwardly by the tip 80 of a screwdriver which has been inserted into the cavity 66 by the person installing the connector. As pressure is applied to the wedge by means of the screwdriver in the direction indicated by arrow 81, the hinges at 64 break and the member 14 slides downwardly in the grooves 42 and 44 to make contact with the cable 68.

As it is shown in FIG. 4, the grooves 42 and 44 are located slightly forwardly of the plane of the wall 74 This is done in order to provide access to the grooves so that the wedge 14 can be fitted into them. Thus, as further pressure is applied by means of the screwdriver, the lower edge 54 of the wedge member 14 presses downwardly on the top of the cable 68 (see FIG. 4) and bends it and/or deforms the insulation 70 into the recess 46 at the edges of the surfaces 48. At the same time, the curved top 56 of the wedge 14 moves to a position slightly below the upper edge of the hole 76. The construction of the wedge is such as to automatically cause it to rock backwardly as it contacts the cable 68. This movement is caused principally by the fact that the projection 62 is positioned at an angle slightly greater than 90° with respect to the plane of the wedge member 14 (e.g., at an angle of about 105° ). Thus, when the wedge 14 slides downwardly, the front edge 63 (FIG. 3) of the projection 62 contacts the cable first. As the wedge moves down further, it rocks backwardly about the edge 63 so that the top edge 56 of the wedge is under the top edge of the hole. This rocking motion is permitted because the only contact between the wedge 14 and the forward and rear walls of the grooves 42 and 44 is by means of the ribs 58. These ribs are tapered so that the member 14 can rock backwardly to fit under the edge of the hole until the rear edges of the ribs mate with the rear walls of the grooves 42 and 44, thus preventing the wedge from rocking beyond the plane of the wall 76.

The foregoing action securely locks the cable in place, and simultaneously locks the connector 10 into the wall 74. The deformation of the cable and/or its insulation helps to grip the cable, although such deformation is not absolutely necessary. As it is indicated in FIG. 1, the ribs 58 are wider at the top of the wedge 14 than at the bottom. Thus, as the wedge 14 slides down in the grooves 42 and 44, the ramp portions 84 of the ribs 58 bear against the sides of the grooves and apply forces in the directions indicated by the arrows 82 (FIG. 3) to the yoke 12 so as to spread it and hold it tightly against the edges of the hole in which it is seated. This, combined with the upward pressure on the upper edge 56 of the member 14 caused by resiliency of the cable which is compressed by the wedge 14, provides a tight wedging action for holding the connector 10 and preventing it from turning in the hole.

The connector 10 holds the cable 68 securely against substantial pulling forces in either direction. If, for example, the left end of the cable 68 shown in FIG. 4 is pulled, this tends to pull the bottom edge 54 of the member 14 to the left. However, this motion is resisted because the bottom portion 60 of the rib 58 abuts against the rear walls of the grooves 42 and 44. If the right end of the cable 68 is pulled, motion of the cable similarly is impeded by abutment of the lower end 60 of the ribs 58 against the front walls of the grooves 42 and 44. However, in neither case are there any substantial dislodging forces exerted on the top 56 of the wedge 14. Thus, it stays in place.

Despite the fact that the connector 10 holds the cable securely, and also is securely fastened into the hole, the connector 10 can be taken apart and reused. This can be accomplished by pressing to the right (FIG. 4) on the upper rear surface 59 of the wedge 14, using either a finger or a screwdriver or the like so as to disengage the wedge from the upper edge of the knock-out hole. Then the installation process is reversed, and the connector is removed from the hole. Since the removal process does not damage it, the connector can be re-used.

Figure 6:
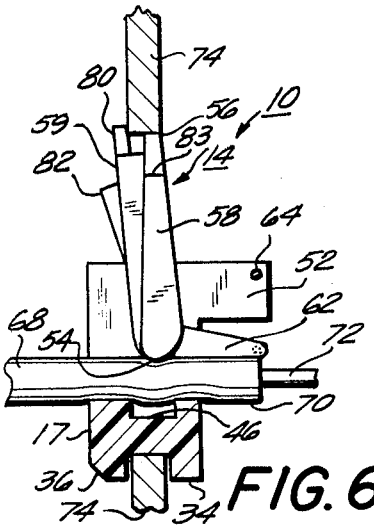
FIG. 6 is a cross-sectional view, like FIG. 4, showing an alternative embodiment of the invention.

An alternative embodiment is shown in FIG. 6, which is a cross-sectional view like that of FIG. 4. This embodiment is the same as that shown in FIGS. 1 through 5 except that an upstanding ridge 80 has been added at the rear portion of the top 56 of the wedge member 14. Also, a second support surface is provided by a projection 82 from the rear surface 59 of the member 14.

The ridge 80 helps hold the wedge member in place in the mounting hole in that it impedes the movement of the member 14 to the right in FIG. 6, as does the projection 62 as it bears against the cable.

The projection 82 provides an upper edge which is closer to the lower edge 54 of the member 14, thus enabling the device to accommodate cable of different sizes. When cable of a diameter larger than that of cable 68 is used, the projection 82 is fitted under the upper edge of the hole 76 instead of the upper edge 56, and the cable is clamped in place as before.

The connector 10 is a relatively compact, simple, low-cost, easy-to-use device. It is readily evident that it meets the objectives set forth above.

FIGS. 7–12 illustrate the preferred connector 100 of the present invention. The connector 100 is identical to the connector 10 shown in FIGS. 1–6, with certain exceptions to be noted below. The same reference numerals are used for corresponding parts in the drawings of the two devices 10 and 100.

One of the principal differences between the present embodiment 100 and the embodiment 10 described above is shown most clearly in FIG. 8, which is a side-elevation view of the connector 100. Instead of the separate projections 28, 34 and 39 which are shown in FIGS. 1 and 2 to hold the connector in the hole in the wall 74 into which the connector is fitted, there is provided a continuous flange 102. Also, in addition to the rear projection 32 at the bottom of the connector 10, there is provided a longer but narrower projection 104 with a sloping forward face 106. The projection 104 extends downwardly considerably below the remainder of the body of the connector 100, as it can be seen in FIGS. 7, 8 and 9.

Figure 12:
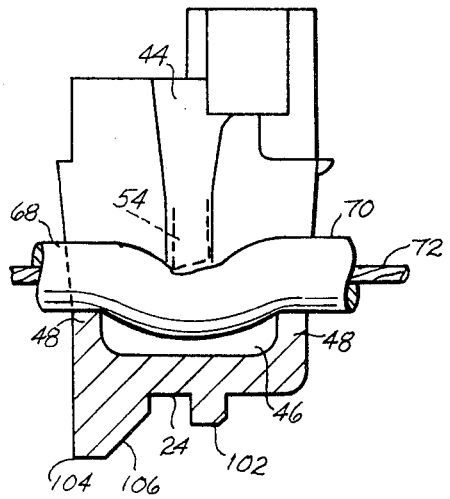
FIG. 12 is a partially cross-sectional view taken along line 12—12 of FIG. 7.

Another change present in the device 100 is illustrated best in FIG. 12. The projecting arms 50 and 52 shown in FIG. 2 of the drawings have been eliminated and the body portion of the connector has been widened so as to provide a wider space 46 within the connector into which the insulated conductor 70 can be depressed.

Figure 8:
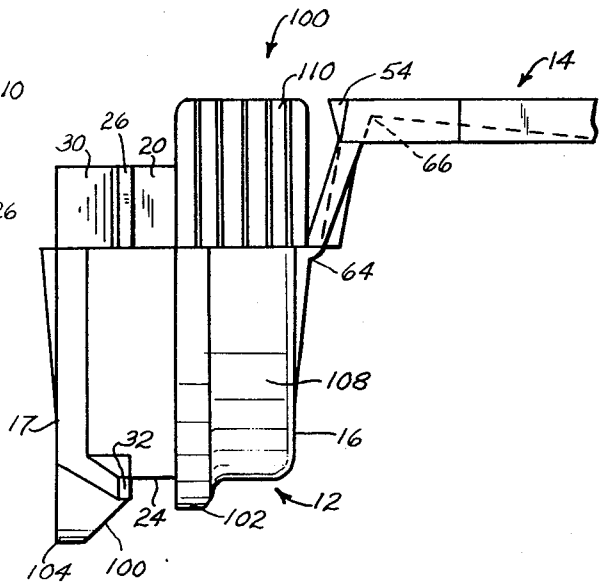

Referring now to FIG. 8, the latter change is accomplished not only by removing the projections 50 and 52, but extending the body of the connector at 108. In addition, the upper portions 110 at the two sides of the yoke have been extended upwardly and have been made broader than in the connector 10 shown in FIG. 1. Additionally, the portions 110 are rounded and are provided with vertical ribbing. This feature provides an enlarged, taller gripping surface which can be gripped more firmly with the fingers and with greater leverage so that the arms of the yoke can be squeezed together more readily with the fingers. This greatly facilitates insertion of the connector into the hole in the receptacle wall 74, as it will be explained in greater detail below.

Another change is that a different foot portion 116 (see FIG. 9) is provided for the wedge structure 14. Two slots 117 are cut in the foot portion so as to form two relatively slender bars 120 connected to the horizontal hinge members 64, thus forming plastic torsion bars to support the wedge member 14. This prevents the hinges 64 from breaking prematurely while the wedge 14 is being rotated 90°; that is, until substantial force has been applied by means of the screwdriver tip.

The slots 117 serve two purposes. They create the torsion bars mentioned above, and also facilitate compression of the yoke by providing a considerable amount of space to absorb lateral movement of the two sides of the yoke towards one another when the yoke is being squeezed for insertion of the connector into the hole in the receptacle wall 74.

Figure 9:
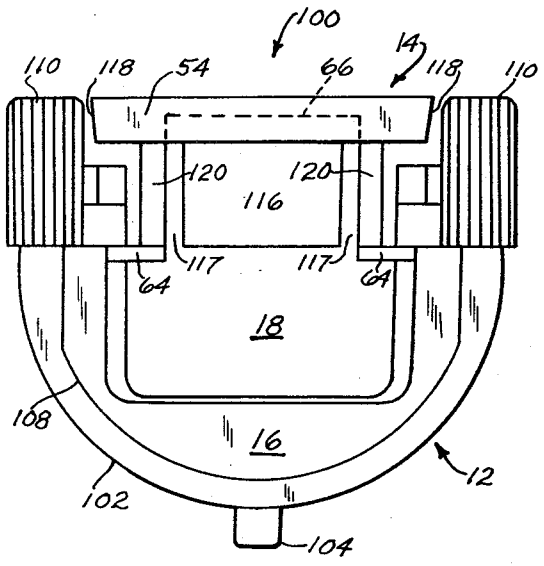
FIGS. 7, 8 and 9 are rear, side and front elevation views, respectively, of the preferred embodiment of the invention.
Figure 7:
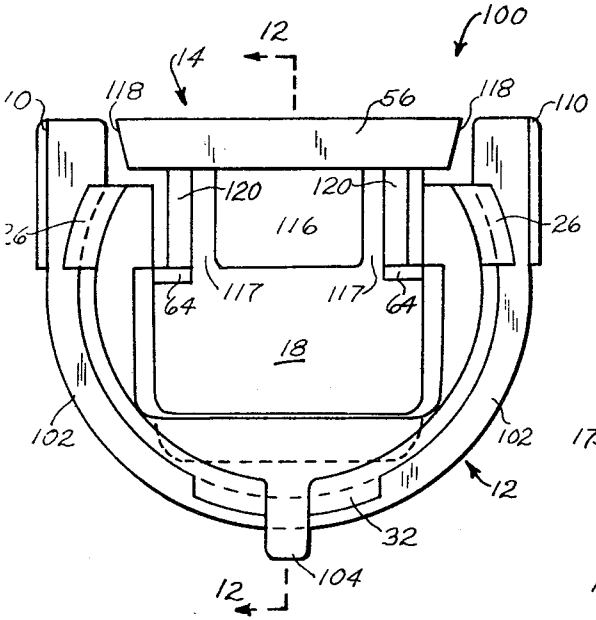

Another change in the wedge member 14 can be seen in FIGS. 7 and 9. The sides edges 118 of the wedge member are bevelled at an angle of 5° or more. As it can be seen in FIG. 11, which is a top plan view of the connector 100, the vertical slots 42 and 44 into which the wedge slides also are bevelled, preferably at the same angle as the edges 118. When the wedge member fits into the slots 42 and 44, the bevelled edges of the lobes 112 of the wedge member are approximately parallel to and form an interference fit with the bevelled edges of the slots 42 and 44. The bevelled edges facilitate rocking action of the wedge under the edge of the hole, and restrain the wedge from moving forwardly and slipping out from under the edge of the hole into which the connector is fitted.

Another change in the wedge member 14 is illustrated in FIGS. 8 and 12. The lower edge 54 of the wedge member 14 has a relatively sharp, pointed edge. As it is shown in FIG. 12, this edge bears downwardly upon the insulation covering of the cable. The relatively sharp edge 54 penetrates slightly into the insulation 70 on the cable, thus providing improved gripping and strain relief.

Figure 10:
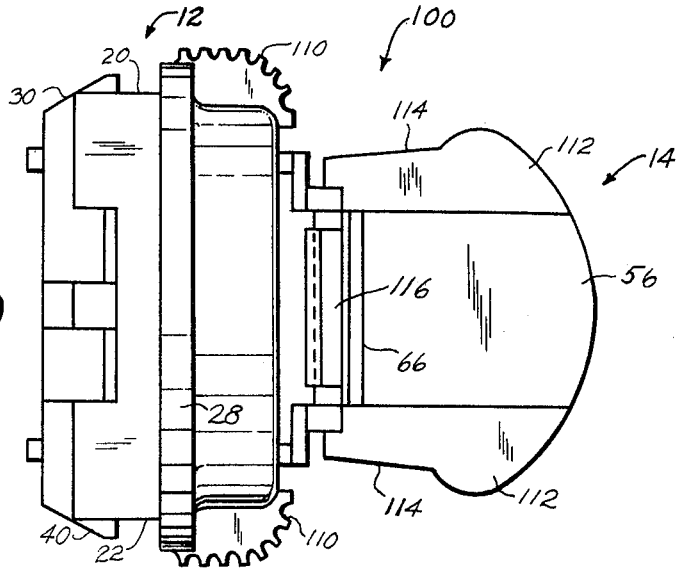
FIGS. 10 and 11 are bottom and top plan views, respectively, of the device shown in FIGS. 7–9.
Figure 11:
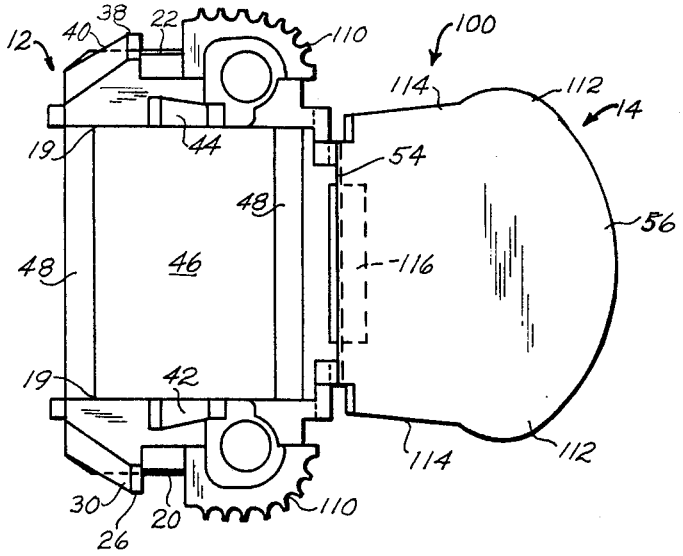

FIGS. 10 and 11 illustrate additional changes in the wedge member 14. The side edges of the wedge member 14 have sloping portions 114, and lobes 112 which protrude beyond the sections 114. The sections 114 help guide the wedges into the slots 42 and 44. When the wedge is pressed downwardly by the tip of a screwdriver or other tool, the lobes 112 tend to spread the sides of the yoke-shaped body of the connector 100 apart so as to seat the connector firmly against the sides of the hole in the receptacle wall 74.

When installing the connector 100, the elongated projection 104 at the bottom of the connector is inserted first through the hole 74 and is hooked over the bottom edge of the hole. Then, the two sides of the yoke are squeezed together by applying finger pressure to the portions 110 of the connector to reduce the width of the connector so that it will fit the hole 74 more easily. Simultaneously, the connector is pushed into the hole. The shape of the connection causes it to act like a lever, with the inside edge near the slot 24 serving as a fulcrum for the lever. The leverage makes the connector easier to insert into the hole.

When it is fully inserted and released, the connector snaps into place, with the edges of the hole seated between the flange 102 and the projections 26 and 32. The continuous flange 102 and the construction of the rear flange and projections 26 tend to hold the connector 100 more solidly in the hole than the connector shown in FIGS. 1-6.

As it was mentioned above, use of the slots 117 (FIG. 9) in the foot portion 116 of the wedge member 14 makes the yoke structure more flexible so that it can be squeezed together more easily and inserted into the hole 74 in the receptacle wall.

The above description of the invention is intended to be illustrative and not limiting. Various changes or modifications in the embodiments described may occur to those skilled in the art and these can be made without departing from the spirit or scope of the invention. For example, although the device of the invention shown in use with flat cable, it also can be used with round cable, with or without modifications to shape the parts to match the round shape of the cable.

I claim:

1. A strain-relief connector for an electrical conductor, said connector comprising a first body member shaped to fit into and engage with the edge of a hole in a wall and with said conductor, a second body member shaped at one side to engage said conductor and at a second side opposite said one side, to engage said edge of said hole, said second body member being shaped to be wedged into a location substantially in the plane of said edge of said hole between said conductor and said edge of said hole, with said first body member mounted in said hole in strain-relieving engagement with said wall, in order to hold said connector and said conductor in place.

2. A connector as in claim 1 in which said second body member being adapted to move into contact with said conductor and pivot in order to move into said hole.

3. A connector as in claim 1 in which said first body member has a recess opposite said second side of said second body member when said first and second body members are assembled together, and first and second body members being dimensioned so as to compress a portion of said conductor into said recess to hold said conductor securely in place.

4. A connector as in claim 1 in which said first body member having an axially-extending central recess adapted to receive said conductor and forming two arms, the outside of said first body member having at least one groove for receiving said edge of said hole, said first body member being made of a flexible resilient material so that said arms can be depressed to allow said first body member to be fitted into said hole.

5. A strain-relief connector for an electrical conductor, said connector comprising a first body member shaped to fit into and engage with the edge of a hole in a wall and with said conductor, a second body member shaped at one side to engage said conductor, and at a second side opposite said one side, to engage said edge of said hole, said second body member being shaped to be wedged into a location between said conductor and said edge of said hole, with said first body member mounted in said hole, in order to hold said connector and said conductor in place, said first body having an axially-extending central recess adapted to receive said conductor and forming two arms, the outside of said first body member having at least one groove for receiving said edge of said hole, said first body member being made of a flexible resilient material so that said arms can be depressed to allow said first body member to be fitted into said hole, said first body member having guide means for receiving side edges of said second body member, said guide means comprising a pair of grooves in opposite side-walls of said arms, said second body member being wider adjacent said opposite side than adjacent said one side so that said second body member spreads said arms of said first body member apart when inserted into said grooves and holds said first body member in said hole.

6. A strain-relief connector for an electrical conductor, said connector comprising a first body member shaped to fit into and engage with the edge of a hole in a wall and with said conductor, a second body member shaped at one side to engage said conductor, and at a second side opposite said one side, to engage said edge of said hole, said second body member being shaped to be wedged into a location between said conductor and said edge of said hole, with said first body member mounted in said hole, in order to hold said connector and said conductor in place, said second body member being adapted to move into contact with said conductor and pivot in order to move into said hole, said first body having an axially-extending central recess adapted to receive said conductor and giving said first body member the shape of a yoke with arms, the outside of said first body member having at least one groove for receiving said edge of said hole, and including guide means comprising a pair of grooves in opposite internal side-walls of said arms, said grooves being shaped to receive opposite edges of said second body member and guide it into contact with said conductor as said one side and allow said second body member to pivot about said one side to tilt and move said second side into said hole.

7. A connector as in claim 6 in which said second body member has the general shape of a rectangular plate with said opposite side being curved to correspond to the curvature of said hole, and including ribs extending from the opposed remaining sides of said second body member, said ribs being only slightly narrower than said grooves adjacent said one side, and being substantially narrower adjacent said other side in order to permit limited tilting of said second body member.

8. A connector as in claim 6 including attachment means for pivotably attaching said second body member to said first body member so that said second body member is pivotable on said first body member for movement into said grooves.

9. A connector as in claim 8 in which said first and second body members and said attachment means comprise one integral molded plastic structure.

10. A connector as in claim 8 in which said attachment means includes a transverse projection adjacent said one side of said second body member, a pair of projections extending axially outwardly from said first body member, said transverse projection being attached by said attachment means to said further projections adjacent the outermost edges thereof.

11. A connector as in claim 1 in which said second body member has a cavity shaped to receive a tool for pressing said second body member to wedge it into said location.

12. A connector as in claim 5 in which said second body member has a generally planar surface and a transverse projection adjacent said one side, the end of said projection farthest from said planar surface being farther from said other side of said second body member than said one side is, whereby said second body member tilts towards said hole when said end of said projection contacts said conductor.

13. A strain relief connector for an electrical conductor, said connector comprising, in combination, a first body member of generally semi-cylindrical shape, said first body comprising a little more than half of a cylinder, said body member having an external groove in at least a part of its outside surface, said external groove being adapted to receive the edge of a hole in a wall, a central axial recess in said first body member, transverse grooves in the side walls of said axial recess, a generally planar second body member with one edge for contacting said conductor and an opposite edge for engaging said edge of said hole, said second body member being adapted to slide in said grooves into engagement with a conductor when said conductor extends axially through the opening formed by said axial recess and said first body member is in strain-relieving engagement with said wall, and being dimensioned to make an interference fit between said conductor and said edge of said hole.

14. A connector as in claim 13 in which said second body member has a cavity for receiving the tip of a screwdriver for the application of force to said second member to effect said interference fit.

15. A connector as in claim 13 including a transverse recess extending from said axial recess, said transverse recess being opposite said one edge of said second body member so as to receive a portion of said conductor which is deformed by the pressure of said one edge of said second body member when making said interference fit.

16. A connector as in claim 13 in which said axial recess is generally rectangular in shape and forms two relatively narrow arms which can be depressed inwardly by side-ways-directed pressure from outside said connector to allow said connector to fit into said hole, said arms being resilient so as to return to a position in which said edge of said wall forming said hole fits into said external groove.

17. A connector as in claim 13 in which said external groove is formed by three separate pairs of projections, two at opposed sides of said first body member, and one pair between the other pair.

18. A connector as in claim 13 in which the width of said second body member increases gradually from adjacent said one edge to adjacent said opposite edge so as to spread said sides of said recess apart as said second member is being moved into engagement with said conductor, thus pressing and holding said first body member against said edge of said hole.

19. A strain-relief connector for an elongated insulated electrical conductor, said connector comprising a first body member shaped to fit into and engage with the edge of a hole in a wall and with said conductor, a second body member shaped at one side to engage said conductor, and at a second side opposite said one side, to engage said edge of said hole, guide means on said first body member for engaging said second body member adjacent said one side to hold said first and second members against relative movement in the longitudinal direction of said conductor but allowing said second body member to pivot about said one side and tilt so as to fit said other side under the edge of said hole with said one side contacting said conductor.

20. A device as in claim 19 in which said second body member has a pivot edge spaced from said one side in the longitudinal direction of said conductor, the distance of said pivot edge from said other side being greater than the distance of said one side from said other side so that said pivot edge contacts said conductor before said one side and tilts the second body member towards and into said hole.

21. A method of providing a strain-relief mounting for electrical cable, said method comprising the steps of providing a connector having a first body member having a conductor passageway and being adapted to fit into a hole in an electrical cabinet wall and fill a substantial portion of said hole, and a second body member shaped to mate with said first body member and to be wedged between said conductor and the edge of said hole to hold the connector and cable in said hole, mounting said first body member in strain-relieving position in said hole, inserting said cable through said passageway, and, by the application of a wedging force in a direction transverse to the longitudinal direction of said conductor and towards the edge of said hole, wedging said second body member between said conductor and said edge after so mounting said first body member.

22. A method of providing a strain-relief mounting for electrical cable, said method comprising the steps of providing a connector having a first body member having a conductor passageway and being adapted to fit into a hole in an electrical cabinet wall and fill a substantial portion of said hole, and a second body member shaped to mate with said first body member and to be wedged between said conductor and the edge of said hole to hold the connector and cable in said hole, mounting said first body member in said hole, inserting said cable through said passageway, and wedging said second body member between said conductor and said edge after so mounting said first body, said second body member being pivoted to said first body member by means of frangible pivot means, including the step of pivoting said second body member about said pivot means and breaking said pivot means during said wedging step.

23. A method of providing a strain-relief mounting for electrical cable, said method comprising the steps of providing a connector having a first body member having a conductor passageway and being adapted to fit into a hole in an electrical cabinet wall and fill a substantial portion of said hole, and a second body member shaped to mate with said first body member and to be wedged between said conductor and the edge of said hole to hold the connector and cable in said hole, mounting said first body member in said hole, inserting said cable through said passageway, and wedging said second body member between said conductor and said edge after so mounting said first body member, said second body member being pivoted to said first body member by means of frangible pivot means, including the step of first breaking said pivot means, then inserting said cable in said passageway, and then mounting said first body member in said hole and inserting said cable through said hole, and then performing said wedging step.

24. A method as in claim 21 in which said wedging force is applied solely by the application of a longitudinal force to an elongated tool engaged with said second body member.

25. A connector as in claim 4 including a projection extending from said first body member at a point relatively remote from the ends of said arms and shaped so as to fit over the edge of a hole into which said connector is to be fitted and having a surface to engage said edge and allow the use of leverage to assist in forcing said connector into said hole.

26. A connector as in claim 4 in which said second body member is pivotably attached between said arms, said second body member being flexible in a direction between said two arms so as to facilitate depressing said arms towards one another to reduce the lateral dimension of said connection and allow said first body member to be fitted into said hole.

27. A connector as in claim 12 in which said transverse projection is slotted so as to make said connector flexible to facilitate its insertion into said hole.

28. A connector as in claim 5 in which the side edges of said second body member and inner side walls of said grooves are bevelled so as to provide increased resistance to motion of said second body member out of said hole when said side edges are seated in said grooves.

29. A connector as in claim 28 in which the bevelled surfaces provide decreased resistance to motion of said second body member into said hole.

* * * * *